US005811720A

United States Patent [19]

Quinnell et al.

[11] Patent Number: 5,811,720

[45] Date of Patent: Sep. 22, 1998

[54] SHOOTING REST WITH RECOIL REDUCTION SYSTEM

[76] Inventors: Glenn D. Quinnell, Ll6 1st St. H.P., Glendive, Mont. 59330; Charles M. Quinnell, P.O. Box 114, Savage, Mont. 59262

[21] Appl. No.: 876,229

[22] Filed: Jun. 16, 1997

[51] Int. Cl.[6] ..... F41A 23/00

[52] U.S. Cl. ..... 89/37.04; 42/94

[58] Field of Search ..... 89/37.04; 42/94

[56] References Cited

U.S. PATENT DOCUMENTS

| | | | |
|---|---|---|---|
| D. 359,337 | 6/1995 | Banfill | D22/108 |
| 2,582,140 | 1/1952 | Leek | 73/167 |
| 2,731,829 | 1/1956 | Wigington et al. | 73/167 |
| 4,026,057 | 5/1977 | Cady | 42/94 |
| 4,333,385 | 6/1982 | Culver | 89/37 |
| 4,799,324 | 1/1989 | Nodo | 42/94 |
| 4,841,839 | 6/1989 | Stuart | 89/37.04 |
| 4,876,814 | 10/1989 | Lombardo | 42/94 |
| 4,987,694 | 1/1991 | Lombardo | 42/94 |
| 5,056,410 | 10/1991 | Pitts | 89/37.04 |
| 5,070,636 | 12/1991 | Mueller | 42/94 |
| 5,414,949 | 5/1995 | Peebles | 42/94 |
| 5,628,135 | 5/1997 | Cady | 42/94 |

*Primary Examiner*—Charles T. Jordan
*Assistant Examiner*—Meena Chelliah
*Attorney, Agent, or Firm*—Richard C. Litman

[57] ABSTRACT

A shooting rest for a rifle which absorbs the recoil produced when the rifle is fired. The invention includes a rifle mounting structure, a base structure, and a swivel plate. The rifle is secured to the rifle mounting structure which has a mechanism for adjusting the elevation of the rifle barrel resting thereon. The rifle mounting structure is slidably engaged to the base structure so that the rifle mounting structure may slide backwards in response to the recoil from firing the rifle. The recoil energy from the rifle is absorbed by several rubber balls when a first bracket mounted to the rifle mounting structure is forced backwards towards the rubber balls which are held in position by a second bracket mounted to the base structure. The base structure may be mounted on a plate which swivels around a vertical axis to allow the rifle to be aimed in different horizontal directions. The swivel plate can be adjustably secured to the edge of a shooting table so that the shooting rest may be used at any rifle range or on any relatively flat surface without permanently attaching it to the surface.

20 Claims, 7 Drawing Sheets

SHOOTING REST WITH RECOIL REDUCTION SYSTEM

CROSS-REFERENCE TO RELATED APPLICATION

This application claims the benefit of U.S. Provisional Patent Application Ser. No. 60/020,552, filed Jun. 21, 1996.

BACKGROUND OF THE INVENTION

1. Field of the Invention

The invention relates to a shooting rest for a rifle which acts to reduce the recoil produced when the rifle is fired. More specifically, the invention relates to a shooting rest which is compact and portable and has the capability of adjusting both the elevation and the direction of the rifle once the rifle is secured to the shooting rest.

2. Description of Related Art

Many devices have been developed for holding a rifle in position during firing of the rifle and absorbing the recoil forces of the rifle. These devices can be useful in a variety of circumstances; for example, they can be used to adjust the gun sights or to test the mechanical integrity and accuracy of the rifle itself. All of these devices either lack the versatility needed to use the device effectively or they are bulky and difficult to transport.

Many of the devices that have been developed lack the ability to allow the marksman to adjust the direction and the elevation of the rifle barrel once it is secured to the device. Since the device needs to be secured to a fixed surface such during testing of the rifle, the marksman may run into trouble if the rifle barrel does not line up with the correct location on the target once it is secured to the table. These devices also lack the ability to be adjustably secured to a table top in a position that is the most comfortable to the marksman.

Many of the devices currently available are large in size and constructed of metal which makes the devices bulky and difficult to transport. Due to the length of the typical rifle, many of the devices which are currently available are long and heavy, thereby making them awkward to move. Accordingly, there is a need for a device which is compact in size thereby making it easy to transport. The device should be sturdy enough to withstand the recoil of the rifle yet lightweight enough to provide for ease of transportation and use. The device should also be capable of absorbing the recoil of a rifle without causing damage to the rifle.

U.S. Pat. No. 2,582,140, issued on Jan. 8, 1952, to Wayne E. Leek describes a shooting rest which uses a resilient pad to absorb recoil. The patent to Leek describes a device which is large and bulky and which lacks the ability to adjust the elevation or the direction of the rifle once the rifle is secured to the device.

U.S. Pat. No. 2,731,829, issued on Jan. 24, 1956, to Everett E. Wigington et al. describes a pistol mount for shooting tests which uses a pair of springs to absorb the recoil. The patent to Wigington lacks the ability to adjust the elevation or direction of the rifle once the rifle is secured to the device.

U.S. Pat. No. 4,333,385, issued on Jun. 8, 1982, to W. Jay Culver describes a shooting rest with a rifle mount that slides on a pair of rods and engages a foamed plastic cushion mounted on the base to absorb recoil. The patent to Culver describes a shooting rest which has the ability to allow the marksman to adjust the elevation and direction of the rifle once the rifle is secured in the device. However, the patent to Culver describes a shooting rest that is nearly the full length of the rifle which makes the device bulky and difficult to transport and set up. The patent to Culver also describes a shooting rest that hooks to the edge of a table and lacks the ability to adjust the distance from the edge of the table that the shooting rest may be positioned thereby making the device potentially awkward and uncomfortable to use.

U.S. Pat. No. 4,799,324, issued on Jan. 24, 1989, to Nicholas L. Nodo describes a rifle recoil attenuator which uses a flexible strap to transfer the recoil forces to a support member. The patent to Nodo describes a device which lacks the ability to adjust the elevation or direction of the rifle once the rifle is secured to the device.

U.S. Pat. No. 5,056,410, issued on Oct. 15, 1991, to Homer E. Pitts describes a rifle recoil absorbing device which uses a pair of springs to absorb the recoil energy. The patent to Pitts describes an elevational adjustment device for the rifle barrel which requires that the marksman line up the elevation by sight and simultaneously tighten a pair of locking screws. This type of adjustment is awkward and not an accurate and efficient method of adjusting the elevation of the rifle. The patent to Pitts also lacks an effective means of holding the rifle barrel in position during and after the recoil motion of the rifle.

U.S. Pat. No. 5,070,636, issued on Dec. 10, 1991, to Evan Mueller describes a swiveling shooting rest which can be secured to the edge of a table. The patent to Mueller describes a shooting rest for a rifle which is nearly the length of a typical rifle. The device described in the patent to Mueller also has numerous adjustment knobs and screws for adjusting the cant and windage of the rifle which makes the device more difficult to adjust and increases the cost to manufacture of the device.

None of the above inventions and patents, taken either singularly or in combination, is seen to describe the instant invention as claimed. Thus a shooting rest with recoil reduction system solving the aforementioned problems is desired.

SUMMARY OF THE INVENTION

The present invention relates to a shooting rest for a rifle which absorbs the recoil produced when the rifle is fired. The invention includes a rifle mounting structure, a base structure, and a swivel plate. The rifle is secured to the rifle mounting structure which has a mechanism for adjusting the elevation of the rifle barrel resting thereon. The rifle mounting structure is slidably engaged to the base structure so that the rifle mounting structure may slide backwards in response to the recoil of the rifle. The recoil energy is absorbed by several rubber balls when a first bracket mounted to the rifle mounting structure is forced backwards towards the rubber balls which are held in position by a second bracket mounted to the base structure.

The base structure may be mounted on a plate which swivels around a vertical axis to allow the rifle to be aimed in different horizontal directions. The swivel plate can be adjustably secured to the edge of a shooting table so that the shooting rest may be used at any rifle range or on any relatively flat surface without permanently attaching it to the surface.

Accordingly, it is a principal object of the invention to provide a device which can absorb the recoil of a rifle when fired without causing damage to the rifle.

It is another object of the invention to provide a device which can absorb the recoil of a rifle and which has a compact structure for ease of transportation.

It is a further object of the invention to provide a device which is sturdy enough to withstand the recoil of the rifle yet lightweight enough to provide for ease of transportation.

Still another object of the invention is to design a device which is versatile enough to be used on a variety of relatively flat surfaces and which can minimize the amount of discomfort and stress on the marksman using the device.

It is an object of the invention to provide improved elements and arrangements thereof in a shooting rest with recoil reduction system for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
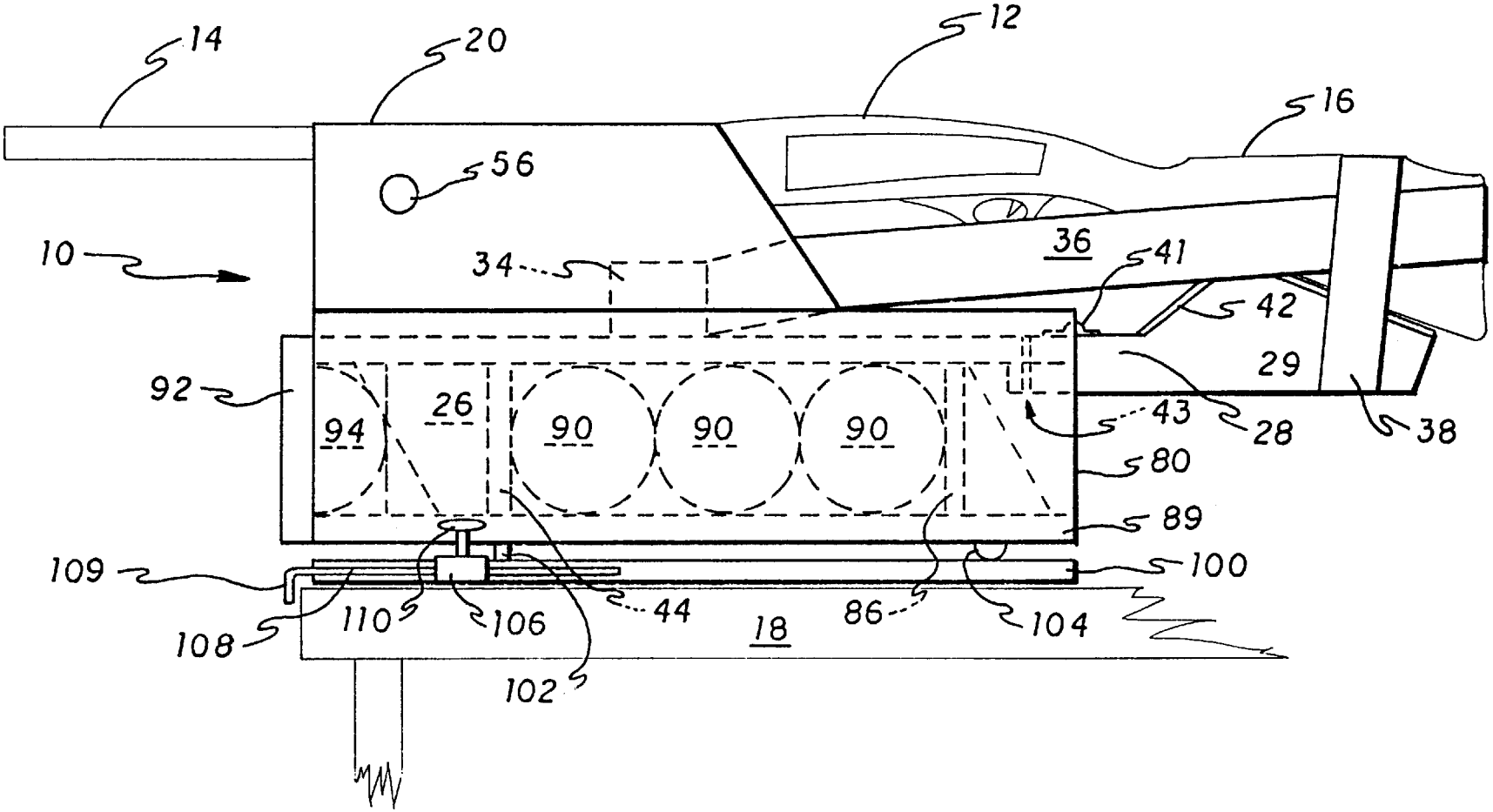
FIG. 1 is an environmental, side elevational view of the present invention with broken lines showing the recoil dampening structure of the invention.

The present invention relates to a shooting rest 10 for a rifle which absorbs the recoil produced when the rifle 12 is fired. Referring to FIGS. 1 through 5, the first embodiment of the present invention includes a rifle mounting structure 20, a base structure 80, and a swivel plate 100. The edges of the rifle mounting structure 20 fit within channels 84 on the base structure 80 so that the rifle mounting structure 20 may slide backwards in response to the recoil from firing the rifle 12. The recoil from the rifle 12 is absorbed by several rubber balls 90 when the first bracket 26 mounted on the underside of the rifle mounting structure 20 is forced backwards towards the rubber balls 90 which are held in position by a second bracket 86 mounted on the base structure 80. The rifle 12 is secured in the rifle mounting structure which has a elevation adjustment mechanism 50 for adjusting the elevation of the rifle barrel 14 resting thereon.

The base structure 80 is mounted on a plate 100 which swivels around a vertical axis 102 to allow the rifle to be aimed in different directions. The swivel plate 100 can be secured to a shooting table 18 so that the shooting rest 10 may be used at any rifle range or on any relatively flat surface without permanently attaching it to the surface.

FIG. 1 shows the shooting rest 10 as it would be used on top of a table 18 at a shooting range or on any other relatively flat surface. The swivel plate 100 is placed on top of the table 18 at a position which is comfortable for the marksman to reach the various parts of the invention and the two elongated rods 108 are adjusted so that the curved ends 109 of the elongated rods 108 hook over the edge of the table 18. The elongated rods 108 can be adjusted by loosening the thumb screws 110 on top of the sleeves 106 which allows the rods 108 to freely slide within the sleeves 106. The thumb screws 110 extend through the sleeves 106 and contact the rods 108 when they are tightened, thereby holding the rods in a fixed longitudinal position within the sleeves 106. The sleeves 106 are rigidly mounted to the swivel plate 100.

When the rifle 12 is fired the recoil force of the rifle will be transferred through the rifle mounting structure 20 through the rubber balls 90 to the base structure 80 and finally to the swivel plate 100. The elongated rods 108 will then serve to hold the swivel plate 100 and the entire shooting rest 10 at a fixed distance from the edge of the table 18.

As shown in FIG. 1, the base structure 80 is pivotally attached to the swivel plate 100 at 102. The pivotal coupling 102 is functionally similar to that used on a Lazy-Susan and the coupling 102 allows the base structure 80 to pivot around a vertical axis at 102. The pivotal coupling 102 allows the marksman to fine tune the direction of the rifle barrel 14 without having to readjust the elongated rods 108 and without having to turn the table 18. The base structure 80 has two legs 104 attached to the bottom side of the base board 89 which stabilize the base 80 upon the swivel plate 100.

It should be noted that in the first embodiment of the shooting rest the thumb screws 110 will prevent the base structure 80 from rotating in a full circle. Due to the placement of the sleeves 106 in nearly an equidistant location with the pivotal coupling 102 from the front of the swivel plate 100, the amount of rotation permitted by the thumb screws 110 is more than sufficient for fine tuning purposes. The design could be modified to prevent any interference between the base structure 80 and the thumb screws 110, such as by modifying the design so that the thumb screws are on the side of the sleeves rather than on top.

Figure 2:
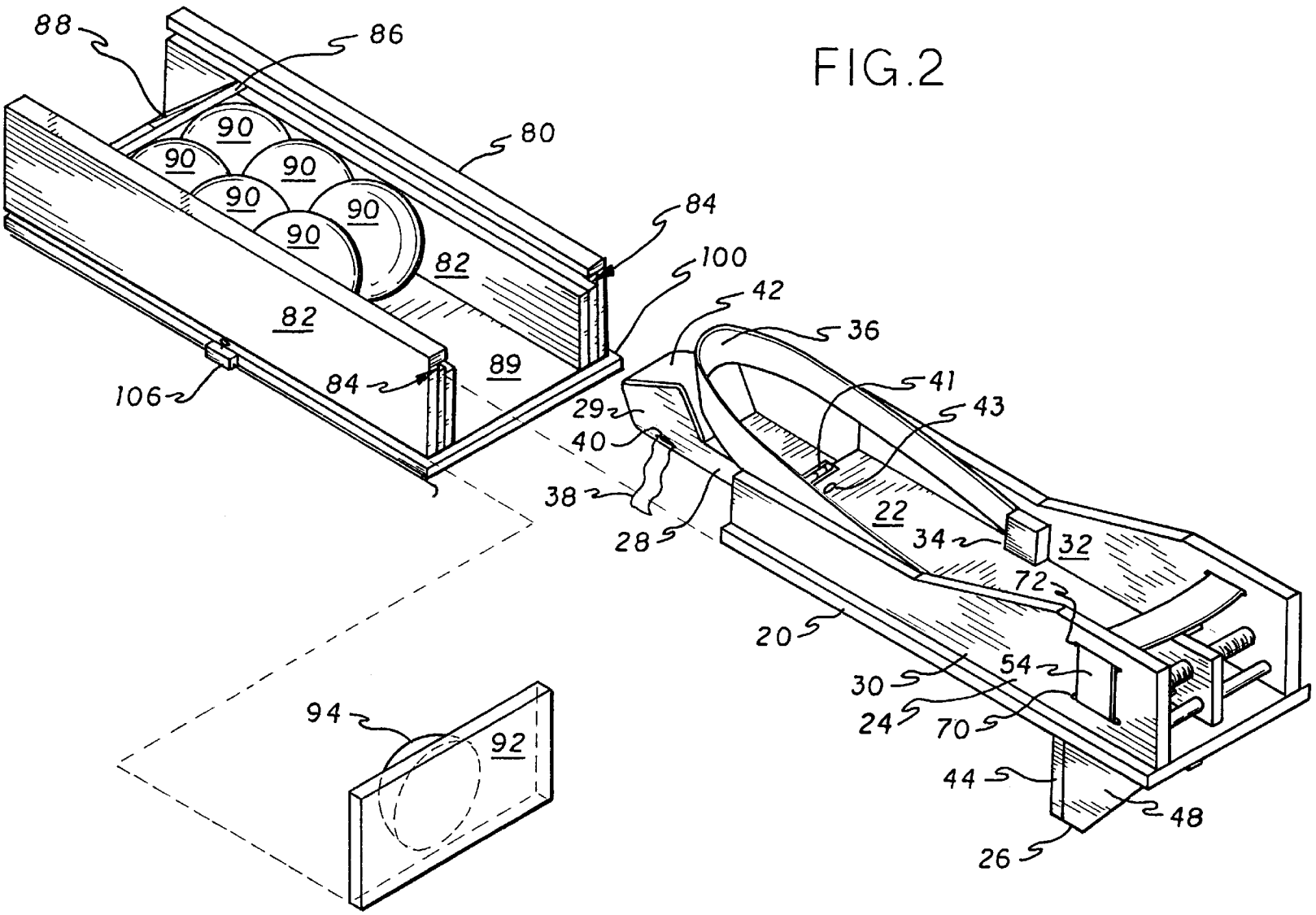
FIG. 2 is an exploded, perspective view of the present invention showing the base structure, the rifle mounting structure, and the recoil rebounding plate.

FIG. 2 shows a perspective view of the base structure 80 which includes a base board 89, two side walls 82 which have channels 84 running along the length of those walls, a second bracket 86, and an open area for holding several resilient recoil dampening devices 90. In the first embodiment of the shooting rest 10, the resilient recoil dampening devices 90 are solid rubber balls, but other similar resilient dampening devices may be used. In the first embodiment, six rubber balls are used which are aligned in two rows of three balls each with each ball sitting flush with all adjacent balls. When the shooting rest 10 is fully assembled the balls 90 should sit relatively flush with the planar member 22 of the rifle mounting structure 20 to keep the balls 90 aligned on a horizontal plane during recoil of the rifle 12. The channels 84 on the base structure 80 support the edges of the planar member 22 of the rifle mounting structure 20 and allow the two pieces to move longitudinally relative to each other. The second bracket 86 is supported by two braces 88.

FIG. 2 also shows a perspective view of the rifle mounting structure 20 which includes an elongated member 28, a planar member 22, a rifle supporting structure 24, an elevation adjustment mechanism 50, and a first bracket 26.

Figure 3:
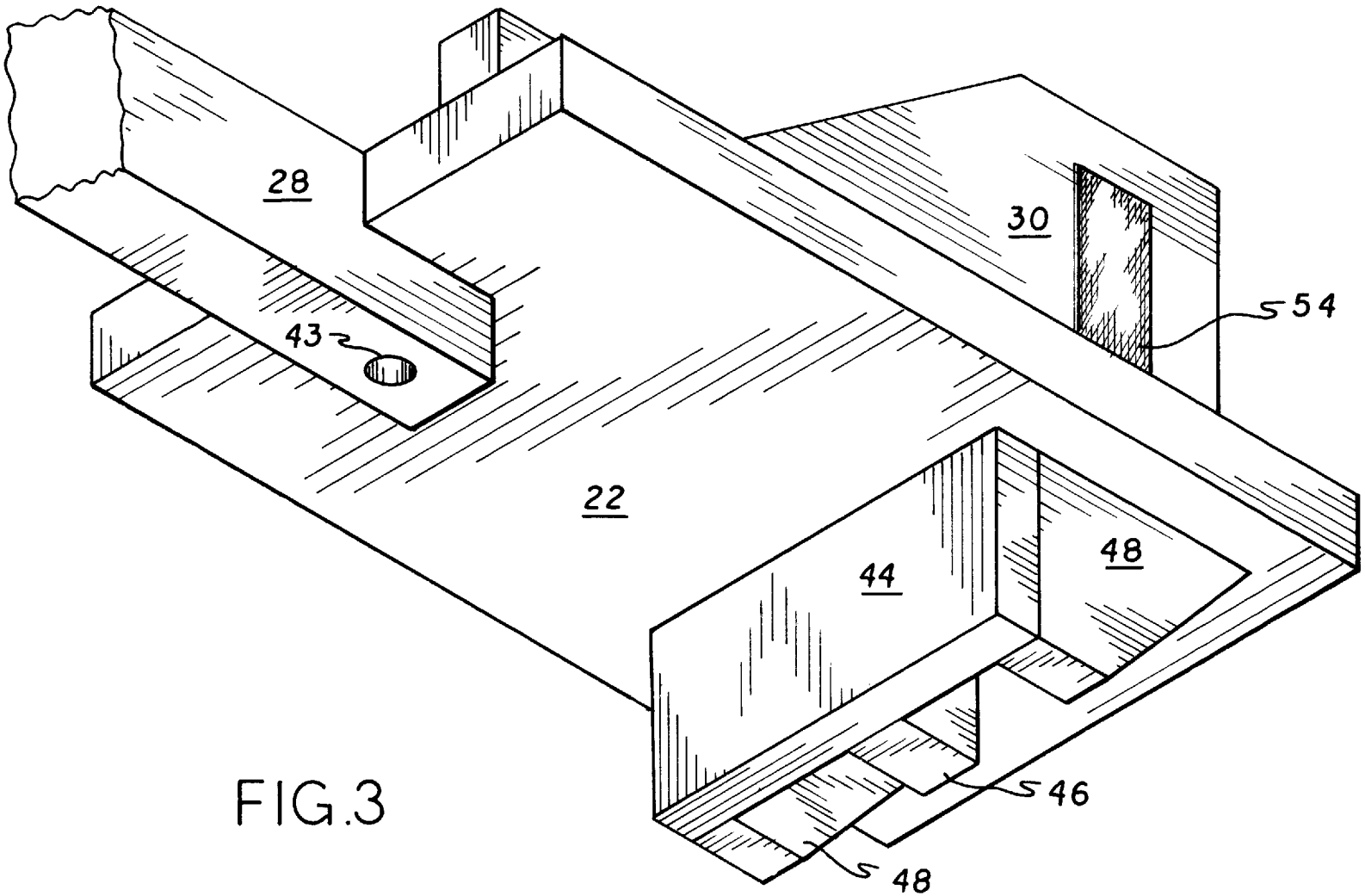
FIG. 3 is a partial bottom perspective view of the rifle mounting structure of the present invention.

FIG. 3 shows a perspective view of the bottom side of the rifle supporting structure 24. When the planar member 22 of the rifle supporting structure 24 is slid within the channels 84 the face plate 44 of the bracket 26 sits flush with the rubber balls 90. The two outer braces 48 and the inner brace 46 give the bracket 26 its support and allow the bracket to transfer the recoil energy from the rifle mounting structure 20 to the rubber balls 90.

Once the rifle supporting structure 24 is in position within the channels 84 of the base structure 80, then a recoil rebounding plate 92 is attached to one end of the base structure 80. The recoil rebounding plate 92 prevents the rifle supporting structure 24 from rebounding off the rubber balls 90 and sliding off the channels 84. When the shooting rest 10 is at rest the rear edge of the inner brace 46 sits flush with a half of a rubber ball 94 which is affixed to the recoil rebounding plate 92. The half rubber ball 94 is essentially the same device as the resilient recoil dampening devices 90 described above, but here the dampening device is cut in half and affixed to the recoil rebounding plate 92. The dampening device 94 can be affixed to the recoil rebounding plate 92 using a variety methods. One such method uses a flexible, non-stretchable strap (not shown) to hold the ball in position by laying the strap over the protruding end of the dampening device 94 thereby pressing it against the plate 92. The strap is affixed by screwing it to the plate 92 on each side of the dampening device 94.

As shown in FIGS. 1 and 2, the rifle mounting structure 20 includes an elongated member 28 which holds the butt end of the rifle 16 in position on the shooting rest 10. The elongated member 28 is attached to the planar member 22 by hinge 41. The hinge 41 allows the shooting rest 10 to fold up into a compact unit during transportation. Note that in the first embodiment the elongated member 28 must be in the folded position in order for the rifle mounting structure 20 to be slid into shooting position on the channels 84 of the base structure 80 without interference from the bracket 86 on the base structure 80. The elongated member 28 can be locked in the non-folded shooting position by the use of a pin (not shown) which is placed through a pair of matching holes 43 in the planar member 22 and the elongated member 28 and held in position by a thumb screw (not shown).

The elongated member 28 includes a contoured support 29, securing strap 38, and a flexible, non-stretchable strap 36 which loops around the butt end of the rifle 16 and transfers the recoil energy to the rifle mounting structure 20. The contoured support 29 is shaped to mate with a typical rifle. The edges of the contoured support 29 that contact the butt end of the rifle 16 are covered by cushions 42 that are meant to protect the rifle from any wear or damage. The first embodiment of the present invention uses leather as the cushioning material, but any type of material with similar protective qualities can be used, such as padded cloth or rubber.

The flexible, non-stretchable strap 36 is affixed to the rifle mounting structure 20 by two blocks 34 which are affixed to the sides 30 and 32 of the rifle supporting structure 24. Since the flexible, non-stretchable strap 36 transfers the recoil energy from the rifle 12 to the shooting rest 10, it is critical that the strap 36 is securely fastened to the rifle mounting structure 20 by the two blocks 34. The blocks 34 can be attached to the rifle mounting structure 20 using a variety of fastening methods, such as bolts or nails. The fastening method used may be adjustable for different length rifles, such as by using bolts to secure the blocks 34 to the rifle mounting structure 20 through a series of holes (not shown) drilled through the sides 30 and 32 of the rifle supporting structure 24 along the length of the rifle supporting structure 24.

The rifle is secured to the elongated member 28 by a strap 38 which is affixed to the elongated member at 40. To secure the rifle 12 to the rifle mounting structure 20, the rifle should be positioned on the elongated member 28 so that the flexible, non-stretchable strap 36 is taut around the butt end of the rifle 16 and the rifle sits flush with the contoured support 29. Then the strap 38 is wound around the butt end of the rifle 16 and attached to itself by hook and loop type fasteners on the strap 38. The rifle 12 is then ready for directional adjustments which will be fully described below.

Figure 4:
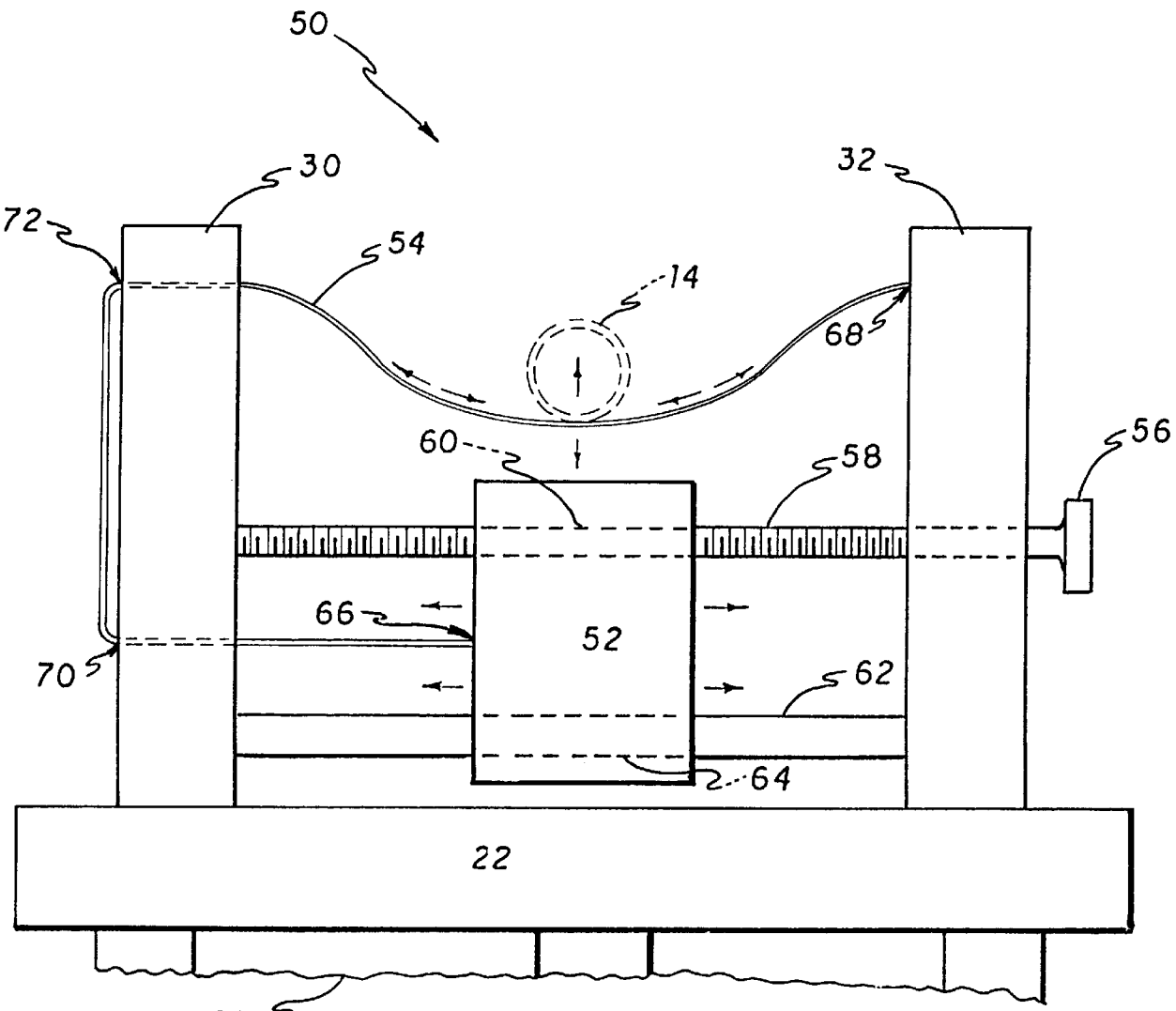
FIG. 4 is a partial, front view of the elevational adjustment mechanism which is connected to the rifle supporting structure.

FIG. 4 shows the elevational adjustment mechanism 50 which is connected to the rifle supporting structure 24 and is used as both a support for the rifle barrel 14 and an adjustment mechanism which allows the marksman to adjust the elevation of the rifle barrel 14. The elevational adjustment mechanism 50 includes a block 52, a pair of parallel support rods 62, a knob 56 rigidly connected to a threaded rod 58, and a flexible, non-stretchable strap 54. The block 52 is slidably mounted at 64 on a pair of support rods 62 which are connected to the side walls 30 and 32 of the rifle supporting structure 24. Elevation of the rifle barrel 14 is achieved when the marksman turns the knob 56 which turns the threaded rod 58. The threaded rod 58 engages the threaded hole 60 in the block 52 which moves the block 52 back and forth along the support rods 62.

One end of the strap 54 is affixed to the block at 66 and is looped through slots 70 and 72 on one side 30 of the rifle supporting structure 24 and the opposite end of the strap 54 is affixed to the opposite side 32 of the rifle supporting structure 24. When the block moves along the support rods 62 towards the side wall 32, the strap 54 is pulled through slots 72 and 70 which tightens the strap between slot 72 and point 68 and thereby forces the rifle barrel 14 upward. When the block 52 moves along the support rods 62 towards the side wall 30, the strap is pulled through slots 70 and 72 due to the weight of the rifle barrel which loosens the strap between slot 72 and point 68 and thereby lowers the rifle barrel 14.

Once the rifle 12 is mounted on the rifle mounting structure 20 and the shooting rest 10 is positioned on the shooting table 18 as shown in FIG. 1, then the direction of the rifle barrel 14 can be adjusted. The horizontal aim of the rifle barrel 14 can be adjusted by rotating the base structure 80 on the swivel plate 100. Once the horizontal aim of the rifle barrel 14 is roughly established, then the elevational adjustment knob 56 can be rotated to adjust the elevation of the rifle barrel 14. Any fine tuning can be done by repeating the two adjustments until the rifle sights are positioned at the appropriate point on the target.

Figure 5:
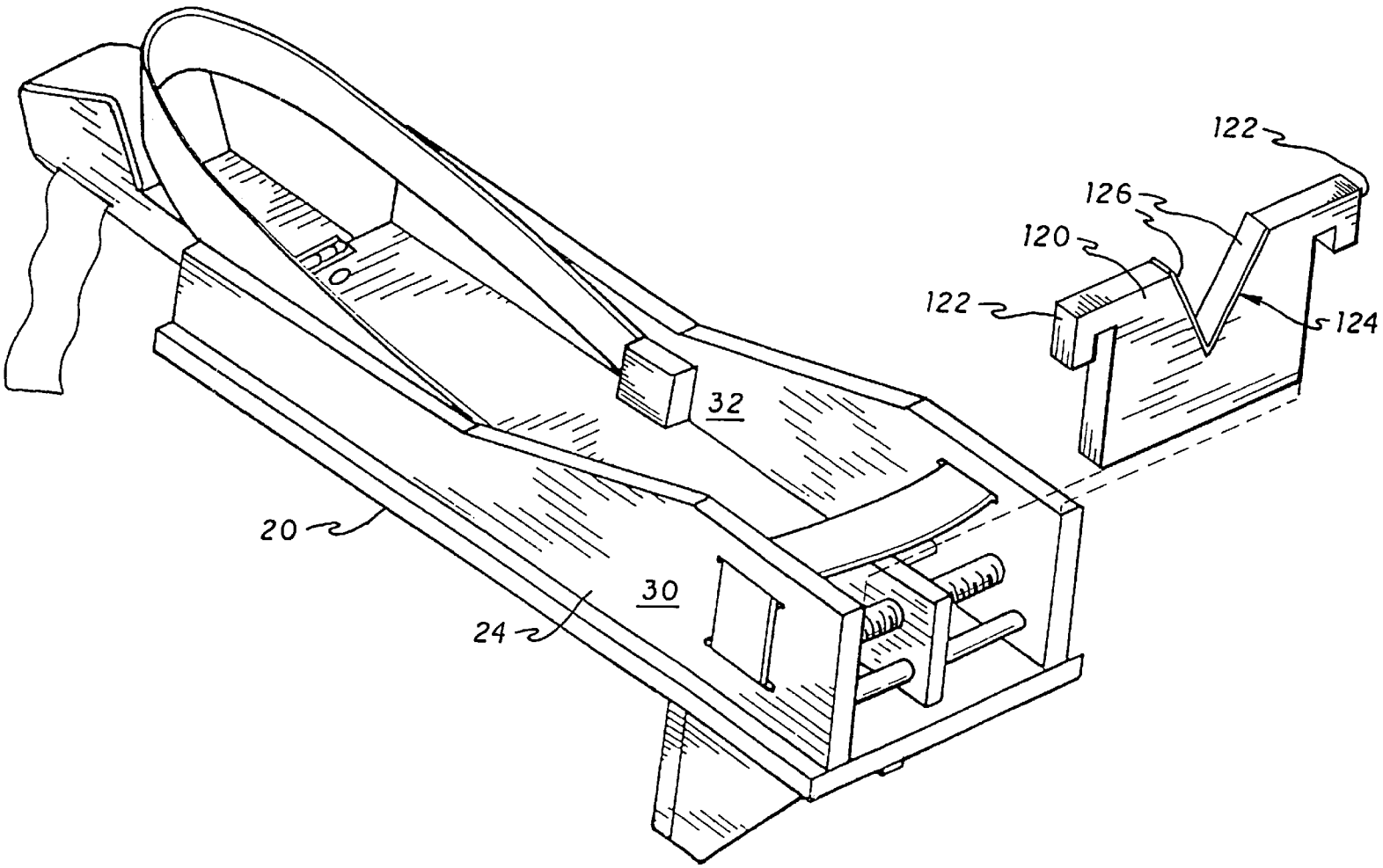
FIG. 5 is a partially exploded, perspective view of the rifle barrel supporting device used during cleaning of the rifle showing where the device attaches to the rifle mounting structure.

Referring to FIG. 5, the present invention includes a rifle barrel supporting device 120 which can be attached to the rifle mounting structure 20 for cleaning the rifle 12. The rifle barrel supporting device 120 has a pair of lips 122 on either side which are designed to allow the rifle barrel supporting device 120 to hang securely from the two side walls 30 and 32 of the rifle supporting structure 24. The rifle barrel supporting device 120 has a V shaped notch 124 which is covered by a cushion made from leather, rubber, padded cloth or some other similar cushioning material to protect the barrel of the rifle 14 from damage. The "V" shaped notch 124 holds the barrel of the rifle 14 in a fixed position during the cleaning of the rifle 12.

The structural components of the shooting rest can be constructed from wood such as oak to create a sturdy structure and to give it an aesthetically pleasing appearance. The various straps 36, 38, and 54 are made from a flexible, non-stretchable material such as nylon. The knob 56 can be made of either plastic or wood such as oak. The support rods 62 and threaded rod 58 can either be made of aluminum or they can be made of brass to provide a corrosion resistant factor.

Figure 6:
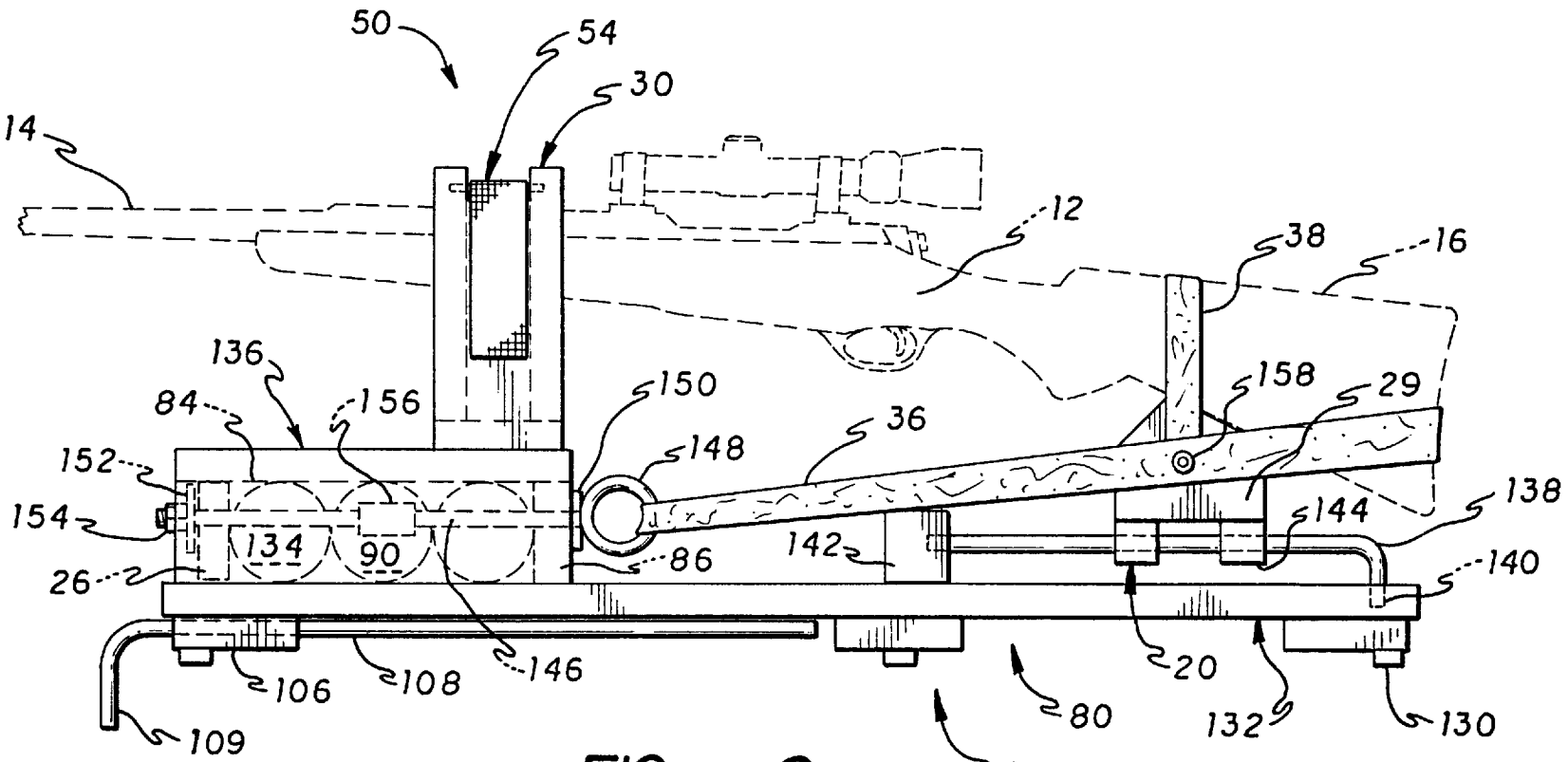
FIG. 6 is a side elevational view of the preferred embodiment of the present invention with broken lines showing the recoil dampening structure of the invention and the relative position of a firearm.

Referring now to FIG. 6, the preferred embodiment of the present invention includes a rifle mounting structure 20 and a base structure 80. The rifle mounting structure 20 includes a first bracket 26 that fits within a channel 84 defined by the base structure 80 so that the rifle mounting structure 20 may slide backwards in response to the recoil from firing the rifle 12. The recoil from the rifle 12 is absorbed by several rubber balls 90 when the first bracket 26 is forced backwards towards the rubber balls 90 which are held in position by a second bracket 86 mounted on the base structure 80. The rifle 12 is secured in the rifle mounting structure 20 and an a elevation adjustment mechanism 50 is used for adjusting the elevation of the rifle barrel 14 resting thereon.

FIG. 6 shows the present invention 10 with the base structure 80 is mounted on a plurality of skid-resistant pads 130 rather than a swivel plate as shown in FIG. 1. It should be noted that a swivel plate may be used with the preferred embodiment of the present invention if so desired. The preferred embodiment includes two elongated rods 108 that may be adjusted so that the curved ends 109 of the elongated rods 108 hook over the edge of a table. The elongated rods 108 can be adjusted by loosening the thumb screws (not shown) that may be located on either the top or on the sides of the sleeves 106 which allows the rods 108 to freely slide within the sleeves 106. The thumb screws extend through the sleeves 106 and contact the rods 108 when they are tightened, thereby holding the rods in a fixed longitudinal position within the sleeves 106.

When the rifle 12 is fired, the recoil force of the rifle will be transferred through the rifle mounting structure 20 through the rubber balls 90 and to the base structure 80. The elongated rods 108 will then serve to hold the base structure 80 and the entire shooting rest 10 at a fixed distance from the edge of the table.

The base structure 80 of the preferred embodiment includes a base board 132, two side walls 134, a top wall 136, a second bracket 86, and an open area for holding several resilient recoil dampening devices 90. Base board 132, side walls 134, and top wall 136 define a channel 84. In the preferred embodiment of the shooting rest 10, the resilient recoil dampening devices 90 are solid rubber balls, but other similar resilient dampening devices may be used. In the preferred embodiment, six rubber balls are used which are aligned in two rows of three balls with each ball sitting flush with all adjacent balls in that row. When the shooting rest 10 is fully assembled the balls 90 should sit relatively flush with the top wall 136 to keep the balls 90 aligned on a horizontal plane during recoil of the rifle 12. The channel 84 on the base structure 80 acts as a track in which the first bracket 26 may slide relative to the base structure 80.

The preferred embodiment of the present invention also includes a rifle mounting structure 20 which includes a pair of elongated track rods 138, a contoured rifle supporting structure 29, a flexible, non-stretchable strap 36, an elevation adjustment mechanism 50, an elongated rod member 146, and a first bracket 26. The pair of elongated track rods 138 are rigidly mounted to base board 132 on one end by a mounting block 142 and on the other end by a pair of holes 140 in the base board 132. The contoured support 29 has holes 144 through the base of the contoured support 29 which allow the contoured support 29 to slide along the length of the elongated track rods 138. The elongated track rods 138 are preferably made of metal, although other rigid materials may be used in the alternative.

The rifle mounting structure 20 further includes a contoured support 29, securing strap 38, and a flexible, non-stretchable strap 36 which loops around the butt end of the rifle 16 and transfers the recoil energy to the rifle mounting structure 20. The contoured support 29 is shaped to mate with a typical rifle. The edges of the contoured support 29 that contact the butt end of the rifle 16 are covered by cushions in the same manner as discussed in the first embodiment. The preferred embodiment of the present invention uses leather as the cushioning material, but any type of material with similar protective qualities can be used, such as padded cloth or rubber.

The flexible, non-stretchable strap 36 is affixed to the elongated rod member 146 by a loop 148 at the end of the rod member 146. Since the flexible, non-stretchable strap 36 transfers the recoil energy from the rifle 12 to the shooting rest 10, it is critical that the strap 36 is securely fastened to the rod member 146. The rod member 146 extends through a washer 150, through a hole in the second bracket 86, between the two rows of resilient recoil dampening devices 90, through a hole in the first bracket 26, through a second washer 152 and is threadably engaged to a bolt 154. The bolt 154 may be tightened or loosened to increase or decrease the force placed on the resilient recoil dampening devices 90 by the first bracket 26 and the second bracket 86, thereby changing the recoil absorption characteristics of the present invention 10 in predictable ways. Note that the rod member 146 may be constructed of two rods with a joint member 156 threadably connecting the two rods, as shown in FIG. 6.

The rifle is secured to the contoured support 29 by a strap 38 which is affixed to the contoured support at 158. To secure the rifle 12 to the rifle mounting structure 20, the rifle should be positioned on the contoured support 29 so that the flexible, non-stretchable strap 36 is taut around the butt end of the rifle 16 and the rifle sits flush with the contoured support 29. Then the strap 38 is wound around the butt end of the rifle 16 and attached to itself by hook and loop type fasteners on the strap 38. Then the rifle 12 is ready for directional adjustments which will be fully described below.

Figure 7:
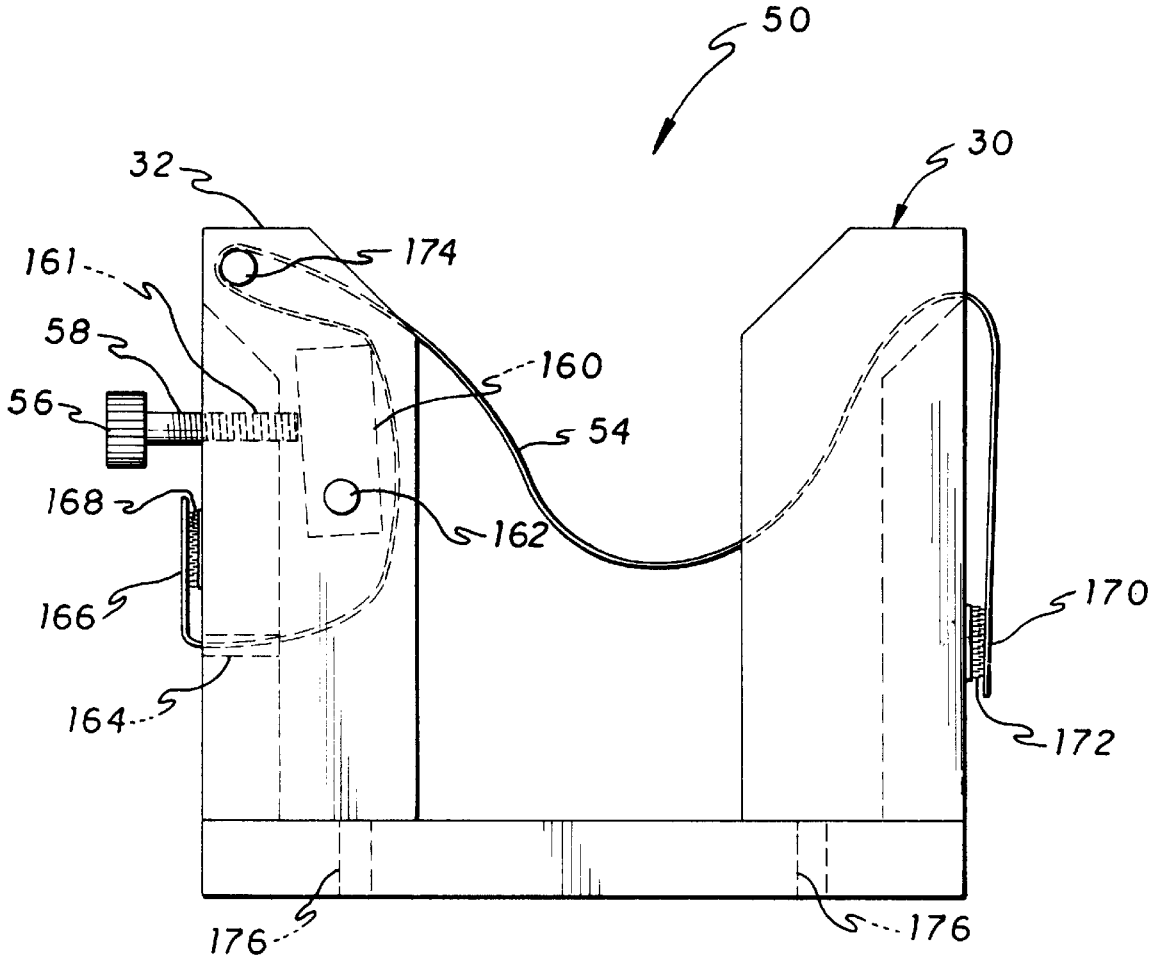
FIG. 7 is a front view of the elevational adjustment mechanism of the preferred embodiment of the present invention.

FIG. 7 shows the elevational adjustment mechanism 50 which is connected to the top wall 136 and is used as both a support for the rifle barrel 14 and an adjustment mechanism which allows the marksman to adjust the elevation of the rifle barrel 14. The elevational adjustment mechanism 50 includes a block 160, two side walls 30 and 32, a knob 56 rigidly connected to a threaded rod 58, and a flexible, non-stretchable strap 54. The block 52 is pivotally mounted to a support rod 162 which is connected to the side wall 32. Elevation of the rifle barrel 14 is achieved when the marksman turns the knob 56 which turns the threaded rod 58. The threaded rod 58 engages and travels through the threaded hole 161 in the side wall 32, thereby forcing the block 52 to pivot about support rod 162.

One end 166 of the strap 54 is affixed to side wall 32 by hook and loop fasteners 168 and is looped through slot 164, around block 160, around rod 174, while the opposite end 170 of the strap 54 is affixed to the opposite side 30 by hook and loop fasteners 172. A rough height adjustment of the rifle barrel may be accomplished by attaching end 170 of the strap 54 to an appropriate height on side wall 30 using hook and loop fasteners 172. A fine adjustment of the height of the rifle barrel is accomplished by turning the knob 56 in the appropriate direction. When the block 160 pivots away from side wall 32 (in a clockwise direction about rod 162 in FIG. 7), the strap 54 is pulled around rod 174, thereby reducing the length of strap 54 between rod 174 and end 170 and forcing the rifle barrel 14 upward. When the block 52 pivots towards the side wall 32 (in a counterclockwise direction about rod 162 in FIG. 7), the weight of the rifle barrel will pull strap 54 around rod 174, thereby increasing the length of strap 54 between rod 174 and end 170 and lowering the rifle barrel 14.

The elevational adjustment mechanism 50 may be removably mounted to the base structure 80 in order to make the device more compact for storage and transportation. The elevational adjustment mechanism 50 may be removably mounted to the base structure by placing thumb screws (not shown) or some other fastening device through holes 176 in the base of the elevational adjustment mechanism 50 and anchoring them to the top wall 136 of the base structure 80. The thumb screws may be anchored using any one of a variety of common methods; for example, the thumb screws could be threadably engaged to corresponding holes (not shown) in the top wall 136 or they could extend through the holes and be threadably engaged to a pair of nuts.

The preferred embodiment of the present invention as shown in FIGS. 6 and 7 has the advantage of being lighter than the first embodiment as shown in FIGS. 1 through 5. Less material is required to construct the preferred embodiment, therefore making the device cheaper to manufacture and easier to transport.

It is to be understood that the present invention is not limited to the embodiment described above, but encompasses any and all embodiments within the scope of the following claims.

We claim:

1. A shooting rest comprising:

a rifle mounting structure including:

means for removably mounting a rifle to said rifle mounting structure, a first bracket, and means for connecting said first bracket to said means for removably mounting a rifle to said rifle mounting structure;

a base structure having a second bracket rigidly attached thereto, said means for removably mounting a rifle to said rifle mounting structure being slidably mounted to said base structure along a longitudinal axis defined by a barrel of the rifle, said first bracket being slidably mounted to said base structure along a longitudinal axis defined by a barrel of the rifle;

a plurality of resilient recoil dampening devices positioned upon said base structure in between said first bracket and said second bracket;

means for adjusting the elevation of the barrel of the rifle resting thereon connected to said rifle mounting structure; and means for adjustably securing said shooting rest to an edge of a relatively flat surface.

2. The shooting rest according to claim 1 further comprising a swivel plate which is pivotally attached to said base structure thereby enabling said base structure to be pivoted around a vertical axis, said swivel plate being connected to said means for adjustably securing said shooting rest to an edge of a relatively flat surface.

3. The shooting rest as defined in claim 1 wherein said means for adjustably securing said shooting rest to an edge of a relatively flat surface includes:

a pair of sleeves rigidly attached to said shooting rest;

a pair of elongated rods slidably mounted within said pair of sleeves, said pair of elongated rods each having a curved end; and a pair of thumb screws threadably engaged to said pair of sleeves, wherein said pair of thumb screws are designed and configured to hold said pair of elongated rods in position within said pair of sleeves.

4. The shooting rest according to claim 1 wherein said means for connecting said first bracket to said means for removably mounting a rifle to said rifle mounting structure includes a strap having two ends rigidly connected to said first bracket and a middle portion looping around a butt end of the rifle along the longitudinal axis defined by the barrel of the rifle, said middle portion being connected to said means for removably mounting a rifle to said rifle mounting structure.

5. The shooting rest according to claim 1 wherein said means for removably mounting a rifle to said rifle mounting structure includes an elongated member hingedly connected to said rifle mounting structure, said elongated member having a portion thereon contoured to mate with a butt end of a rifle, and said elongated member having means for securing the butt end of the rifle to said elongated member.

6. The shooting rest as defined in claim 1 wherein:

said rifle mounting structure includes a planar member having said first bracket rigidly attached to one side of said planar member;

said base structure includes a planar member having said second bracket rigidly attached thereto and two opposing side supports rigidly attached thereto, said side supports having opposing channels, said channels slidably mating with said planar member of said rifle mounting structure; and said base structure further includes a recoil rebounding plate having a resilient recoil dampening device attached thereto which contacts the rear of said first bracket of said rifle mounting structure.

7. The shooting rest as defined in claim 1 wherein said means for adjusting the elevation of the barrel of the rifle resting thereon includes:

a first wall mounted to said rifle mounting structure, said first wall having a first slot therethrough and a second slot therethrough;

a second wall opposing said first wall and mounted to said rifle mounting structure;

a rod rotatably mounted to said first wall and said second wall, said rod having a threaded portion oriented between said first wall and said second wall;

a member having a hole therethrough, said hole being threadably engaged to said threaded portion of said rod; and a strap having a first end and a second end, said first end being attached to said member, said strap extending through said first slot and said second slot on said first wall, said second end of said strap being attached to said second wall.

8. The shooting rest as defined in claim 1 wherein said means for adjusting the elevation of the barrel of the rifle resting thereon includes:

a first wall mounted to said rifle mounting structure, said first wall having a pin mounted thereon;

a second wall opposing said first wall and mounted to said rifle mounting structure;

a member pivotally mounted to said first wall;

a rod threadably and rotatably mounted to said first wall, one end of said rod abutting said member; and a strap having a first end and a second end, said first end being attached to said first wall, said strap extending around said member and around said pin, said second end of said strap being adjustably attached to said second wall.

9. The shooting rest as defined in claim 1 further comprising a rifle barrel supporting bracket demountably attached to said rifle mounting structure, said rifle barrel supporting bracket having a V-shaped notch thereon, said V-shaped notch having cushioning attached thereto.

10. The shooting rest as defined in claim 1 wherein said resilient recoil dampening devices are six spheres oriented upon said base structure in two rows of three spheres each, said rows being oriented along the longitudinal axis of the barrel of the rifle.

11. A shooting rest comprising:

a rifle mounting structure including:

means for removably mounting a rifle to said rifle mounting structure, and a first bracket related to said means for removably mounting a rifle to said rifle mounting structure;

a base structure having a second bracket rigidly attached thereto, said means for removably mounting a rifle to said rifle mounting structure being slidably mounted to said base structure along a longitudinal axis defined by a barrel of the rifle;

a plurality of resilient recoil dampening devices positioned upon said base structure in between said first bracket and said second bracket;

means for adjusting the elevation of the barrel of the rifle resting thereon connected to said base structure; and means for adjustably securing said shooting rest to an edge of a relatively flat surface.

12. The shooting rest according to claim 11 further comprising a swivel plate which is pivotally attached to said base structure thereby enabling said base structure to be pivoted around a vertical axis, said swivel plate being connected to said means for adjustably securing said shooting rest to an edge of a relatively flat surface.

13. The shooting rest as defined in claim 11 wherein said means for adjustably securing said shooting rest to an edge of a relatively flat surface includes:

a pair of sleeves rigidly attached to said shooting rest;

a pair of elongated rods slidably mounted within said pair of sleeves, said pair of elongated rods each having a curved end; and a pair of thumb screws threadably engaged to said pair of sleeves, wherein said pair of thumb screws are designed and configured to hold said pair of elongated rods in position within said pair of sleeves.

14. The shooting rest according to claim 11 wherein said rifle mounting structure includes a means for applying a predetermined force upon said plurality of resilient recoil dampening devices.

15. The shooting rest according to claim 11 wherein said means for connecting said first bracket to said means for removably mounting a rifle to said rifle mounting structure includes a strap having two ends rigidly connected to said first bracket and a middle portion looping around a butt end of the rifle along the longitudinal axis defined by the barrel of the rifle, said middle portion being connected to said means for removably mounting a rifle to said rifle mounting structure.

16. The shooting rest according to claim 11 wherein said means for removably mounting a rifle to said rifle mounting structure includes a member having a portion thereon contoured to mate with a butt end of a rifle, said contoured member having means for securing the butt end of the rifle to said contoured member.

17. The shooting rest according to claim 16 wherein:

said contoured member has a pair of holes therethrough; and said base structure has a pair of rods rigidly mounted thereto, said pair of rods having longitudinal axes parallel to the longitudinal axis defined by the barrel of the rifle, said holes of said contoured member being slidably connected to said rods.

18. The shooting rest as defined in claim 11 wherein said means for adjusting the elevation of the barrel of the rifle resting thereon includes:

a first wall mounted to said base structure, said first wall having a first slot therethrough and a second slot therethrough;

a second wall opposing said first wall and mounted to said base structure;

a rod rotatably mounted to said first wall and said second wall, said rod having a threaded portion oriented between said first wall and said second wall;

a member having a hole therethrough, said hole being threadably engaged to said threaded portion of said rod; and a strap having a first end and a second end, said first end being attached to said member, said strap extending through said first slot and said second slot on said first wall, said second end of said strap being attached to said second wall.

19. The shooting rest as defined in claim 11 wherein said means for adjusting the elevation of the barrel of the rifle resting thereon includes:

a first wall mounted to said base structure, said first wall having a pin mounted thereon;

a second wall opposing said first wall and mounted to said base structure;

a member pivotally mounted to said first wall;

a rod threadably and rotatably mounted to said first wall, one end of said rod abutting said member; and a strap having a first end and a second end, said first end being attached to said first wall, said strap extending around said member and around said pin, said second end of said strap being adjustably attached to said second wall.

20. The shooting rest as defined in claim 11 wherein said resilient recoil dampening devices are six spheres oriented upon said base structure in two rows of three spheres each, said rows being oriented along the longitudinal axis of the barrel of the rifle.

* * * * *